US007802406B2

(12) United States Patent
Simmons

(10) Patent No.: US 7,802,406 B2
(45) Date of Patent: Sep. 28, 2010

(54) MULTI-FUNCTION BUILDING PANEL BEAM TUBE WITH HOMOGENEOUS ANCHOR SITES

(76) Inventor: Robert J. Simmons, 27308 Fairview Ave., Hayward, CA (US) 94542

( * ) Notice: Subject to any disclaimer, the term of this patent is extended or adjusted under 35 U.S.C. 154(b) by 715 days.

(21) Appl. No.: 11/243,744

(22) Filed: Oct. 4, 2005

(65) Prior Publication Data

US 2006/0075714 A1 Apr. 13, 2006

Related U.S. Application Data

(60) Provisional application No. 60/617,276, filed on Oct. 9, 2004.

(51) Int. Cl.
*E04H 1/00* (2006.01)
*E04B 5/00* (2006.01)

(52) U.S. Cl. ..... 52/235; 52/236.3; 52/264; 52/236.9

(58) Field of Classification Search ..... 52/79.9, 52/79.12, 236.3, 250, 262, 582.1, 582.2, 52/284, 235, 234, 633, 474, 285.2, 637, 651.11, 52/293.3, 238.1, 274, 270, 236.9, 264, 251, 52/79.11, 79.13, 253, 289
See application file for complete search history.

(56) References Cited

U.S. PATENT DOCUMENTS 2,076,728 A * 4/1937 Keller ..... 52/210
2,914,145 A 11/1959 Benson
3,053,353 A 9/1962 Miller
3,315,426 A * 4/1967 Rolland ..... 52/235
3,805,465 A 4/1974 Dietrich
3,844,077 A 10/1974 Vance
4,121,396 A 10/1978 Oogami et al.
4,519,173 A * 5/1985 Roberts ..... 52/235
4,574,546 A 3/1986 Gartner
4,794,744 A 1/1989 Young et al.
4,813,193 A * 3/1989 Altizer ..... 52/210
5,063,718 A * 11/1991 Nonis ..... 52/235
5,669,194 A * 9/1997 Colasanto et al. ..... 52/236.8
5,782,047 A * 7/1998 De Quesada ..... 52/236.6
6,260,320 B1 * 7/2001 Di Lorenzo ..... 52/414
6,298,617 B1 * 10/2001 de Quesada ..... 52/236.3
6,460,297 B1 * 10/2002 Bonds et al. ..... 52/79.1
6,665,988 B2 * 12/2003 Toivola et al. ..... 52/204.1

(Continued)

*Primary Examiner*—Richard E Chilcot, Jr.
*Assistant Examiner*—Anthony N Bartosik
(74) *Attorney, Agent, or Firm*—Jon M. Dickinson, PC; Robert D. Varitz, PC

(57) ABSTRACT

A skin-panel sub-frame panel having spaced, upper, lower and lateral edges, designed to occupy an upright plane adjacent the outside of a plural-story building frame, with a vertical dimension which is substantially the same as inter-floor story-height in the frame. The sub-frame includes (a) an elongate beam component defining the sub-frame's upper edge, and (b) plural interconnect-accommodating site structure sets formed in and distributed along the length of that component organized with (1) a first, upwardly facing set, and (2) a second inwardly facing set, which sets define orthogonally intersecting interconnect planes. Each first set accommodates a position-stabilizing, load-transferring inter-sub-frame interconnection between a pair of vertically next-adjacent sub-frames, and each second set accommodates a similar interconnection between a sub-frame and building infrastructure which is located within the mentioned building frame. Elongate lateral extension structures interconnect the panels with poured-in-place floor structure disposed within the associated building frame.

8 Claims, 2 Drawing Sheets

U.S. PATENT DOCUMENTS 7,131,239 B2 * 11/2006 Williams ..... 52/169.5
7,219,474 B2 * 5/2007 Lawson et al. ..... 52/250
7,644,549 B2 * 1/2010 Speck ..... 52/235
2004/0068944 A1 * 4/2004 Dalton ..... 52/236.9
2004/0098934 A1 * 5/2004 Lawson et al. ..... 52/270
2005/0235594 A1 * 10/2005 Hildreth ..... 52/633
2005/0279039 A1 * 12/2005 Konopka ..... 52/407.1

* cited by examiner

MULTI-FUNCTION BUILDING PANEL BEAM TUBE WITH HOMOGENEOUS ANCHOR SITES

CROSS REFERENCE TO RELATED APPLICATION

This application claims priority to prior-filed currently co-pending U.S. Provisional Patent Application Ser. No. 60/617,276, filed Oct. 9, 2004, for "Multi-Function Building Panel Beam Tube with Homogeneous Anchor Sites". The entire disclosure content of that prior-filed case is hereby incorporated herein by reference.

BACKGROUND AND SUMMARY OF THE INVENTION

This invention relates to plural-story building structure, and within such structure, what is referred to herein as a generally planar skin-panel sub-frame which uniquely includes a plural-function, singular-structure, overhead building beam component which, fundamentally, forms a top, tubular, beam-like structural member in that subframe.

In the building of plural-story building structures, there is a continual effort to improve, simplify, and reduce the cost of overall building expense, with substantial focus being directed not only to elements of a main building frame structure per se, but also to other structures, both external and internal which link directly for support with beams and columns in such a main frame structure. A particular area of development which has drawn considerable interest in recent years involves the design and use of various kinds of surfacing structures which become attached in various ways to the outside surfaces of beams and columns to form what might be thought of as the outside skin structure for a building. To this end, a number of different approaches have been proposed, one of which is described and illustrated in recently published, and currently pending, U.S. patent application Ser. No. 10/818,014, filed Apr. 5, 2004, for "Matrix Frame/Panel Skin Building Structure". This published patent application, published Oct. 14, 2004, bears U.S. Patent Application Publication No. 2004/0200178, and the contents of that application, in terms of its disclosure material, are hereby incorporated herein by reference for the purpose of furnishing useful background material for understanding the construction and utility of the present invention.

In that patent-application described skin-panel system, generally rectangular sub-frames which are effectively modular in nature, and which have been designed to work cooperatively with the specific placements of columns and beams in a main frame structure, are suitably attached in a row-and-column fashion (vertically and horizontally) to the outside surfaces of columns and/or beams, for the purpose of supporting whatever has been chosen to become the specific outside surfacing "skin" of the finished building. The present invention is directed generally to offering certain load-transfer connection improvements in the system described in this published patent application, and in particular, in the manners in which vertically next-adjacent panels become interconnected with one another. The invention also relates importantly to how these panels also are uniquely connected, in most instances, from the outside of a main building frame to inside the frame, and specifically to certain building infrastructure which, in accordance with a preferred embodiment of the invention disclosed herein, takes the form of poured-in-place concrete floor structures each of which reside at a different one of the story levels in a plural-story building. In some instances, where columns lie outside the plane where surfacing structure is placed, panel connections to the frame, and if desired directly to inside floor structure, will be routed appropriately differently in a manner to be chosen by the builder.

In the preferred embodiment of the invention, a panel, or sub-frame, of the present invention is intended to be mounted on the outside (as distinguished from an alternative placement inside) of the columns in a building frame in much the manner generally described in the above-referred-to published patent application, and is illustrated herein, though this is no necessary constraint of the invention, to be formed with a panel height which is substantially the same as an integer multiple (illustrated as one (1) herein) of the vertical spacings between stories, or floors, in a building. Thus, a panel, as described herein, essentially extends between two vertically spaced individual floors in a building, with an appropriate height to accomplish this. The panel, or sub-frame, of this invention may be designed to carry various kinds of outside surfacing structures which do not form any part of the present invention.

According to the invention, a main structural member in such a building panel (sub-frame) takes the form of an elongate, hollow, tubular (or like) member which lies at the top of the sub-frame with a horizontal disposition, and which is formed, in accordance with a preferred form of the invention, with two distributed rows of sets of preferably homogenously (or welded in place, if desired) threaded through-bushings (which can include welded-in-place through-bushings), one of which rows faces upwardly, and the other of which rows faces inwardly toward the inside of a building when the associated sub-frame is appropriately mounted on the associated building frame—specifically, on the outer side of that frame. These bushings, which are referred to herein collectively as interconnect-accommodating site structures, are organized into two, upwardly and inwardly facing sets (referred to herein as site-structure sets), and accommodate orthogonally related load-transfer connections (a) between vertically stacked, next-adjacent sub-frames, and (b) for the ends of elongate, lateral-extension rebar, or rebar-like, elements which extend horizontally inwardly and embeddedly into poured concrete floor structure which forms part of the main-frame-supported infrastructure in a building. As will become apparent to those skilled in the art, embedment in poured concrete is, of course, not the only successful manner for establishing structural ties to the ends of rebar, or rebar-like, elements.

The upwardly facing interconnect-accommodating site structures accommodate interfacial connections between the confronting upper and lower edges of vertically next-adjacent sub-frames, and preferably, these interconnections between vertically next-adjacent sub-frames permit a limited amount of in-plane vertical and horizontal relative motions between adjacent panels. Such interfacial connections may be implemented through bolts (specifically illustrated herein), or through elongate, in-plane tongue-and-groove structures (not specifically shown herein). Such bolts and tongue-and-groove structures are also referred to herein as anchoring connector structure.

These and other features, and the attendant advantages, of and offered by the structure of the present invention will become more fully apparent as the description which now follows is read in conjunction with the accompanying drawings.

It should be noted that the relative sizes and relationships of various components shown in these figures are not necessarily drawn to scale.

DETAILED DESCRIPTION OF THE INVENTION

Figure 1:
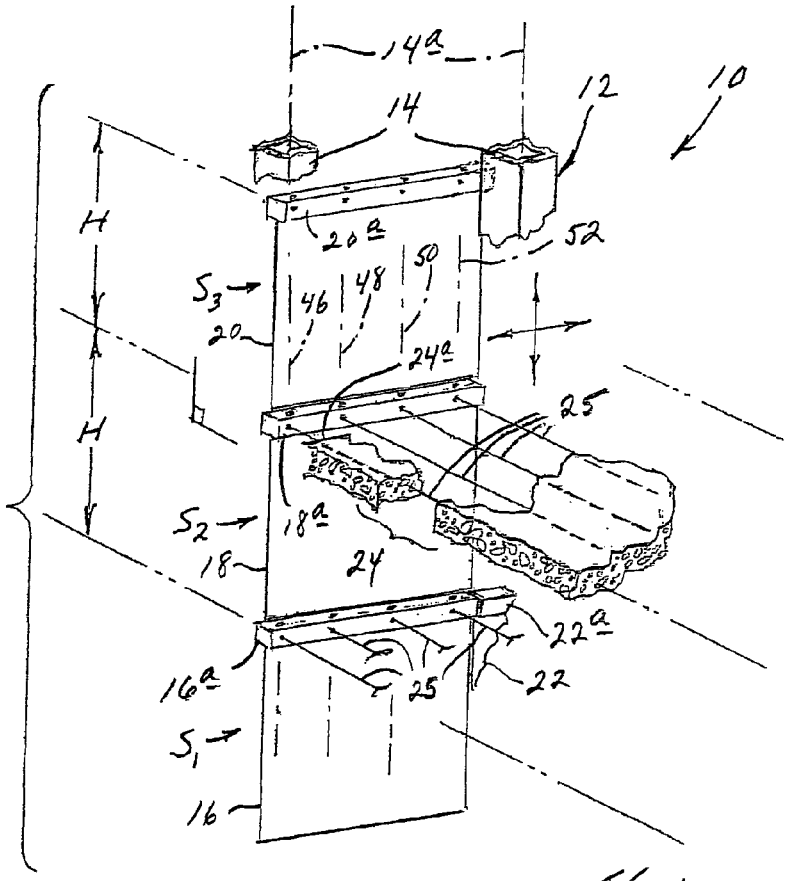
FIG. 1 is a fragmentary, simplified, isometric view of a plural-story building structure main frame, looked at from the inside of that frame, and showing, very schematically, plural, vertically next-adjacent, skin-panel sub-frames which are constructed in accordance with the invention, and which are secured load-tranmissively in place relative to the building main frame also in accordance with preferred practice of the invention.

Turning now to the drawings, and referring first of all to FIG. 1, indicated fragmentarily and schematically generally at 10 is a plural-story building which includes a main frame 12 made up of plural, upright, laterally distributed, tubular columns, such as the two columns shown fragmentarily at 14, interconnected by suitable horizontally extending beams, which are not shown in this figure. Columns 14, are, of course, elongate and vertically upright, with these elongate columns having upright long axes, such as the two column axes shown in dash-dot lines at 14*a* in FIG. 1. Along the sides of frame 12, the upright columns distributed therealong lie generally in an upright plane which is the plane, for example that contains axes 14*a* in FIG. 1.

Frame 12 has an inner side, or an inside, which generally faces toward the viewer in FIG. 1, and an outer side, or outside which faces generally in the opposite direction in FIG. 1. Thus, FIG. 1 presents an isometric view taken essentially from the inner side of frame 12. The outer sides of the outer columns in frame 12, such as the outer sides of columns 14, lie in what is referred to herein as a generally planar main frame expanse.

In FIG. 1, essentially three stories of building 10 and frame 12 are illustrated generally at $S_1$, $S_2$ and $S_3$ in this figure. These stories have what is referred to herein as an inter-floor story height H which is marked as can be seen for stories $S_2$ and $S_3$ in FIG. 1.

Suitably mounted on the outer sides of columns 14 in FIG. 1 are three generally planar, rectilinear (substantially square) skin-panel sub-frames 16, 18, 20 which are shown only in a very simplified form in FIG. 1, with sub-frame 16 being located, so-to-speak, within building story $S_1$, sub-frame 18 being located within building story $S_2$, and sub-frame 20 being located in building story $S_3$.

Included, among other structure which will soon be described, in each of these sub-frames are elongate upper or overhead tubular beam components such as the three beam components shown at 16*a*, 18*a*, 20*a* for sub-frames 16, 18, 20, respectively. More will be said about the roles played by components 16*a*, 18*a*, 20*a* shortly with respect to the other drawings figures herein, as a more detailed description of each sub-frame is given.

Sub-frames, such as sub-frames 16, 18, 20, are described herein as being modular in nature, and distributed over the outside of frame 12 in a state of column-and-row, vertical-and-horizontal, edge-by-edge adjacency, whereby the three sub-frames shown at 16, 18 and 20 are seen to occupy a columnar relationship, with sub-frames 16, 18 taking the form of a pair of sub-frames which lie in vertical next-adjacency, and sub-frames 18, 20 also so lying.

Shown at 22 in FIG. 1 is a fragment of yet another sub-frame which is similar to sub-frames 16, 18, 20, and which lies in a condition of lateral next-adjacency with respect to the right side of sub-frame 16 in FIG. 1. Sub-frame 22 includes an overhead beam component 22*a* which is like the other overhead beam components just mentioned above.

While it will be apparent that each of the sub-frames so far described herein has a vertical dimension which is substantially the same as inter-floor-story height H, it should be understood that different kinds of sub-frame dimensionalities can be selected for use if desired. Preferably, the vertical dimension of each sub-frame is an integer multiple of story height H, and in the illustration presented in FIG. 1, the integer number is, of course, 1.

Included as building infrastructure which is located on the inside of frame 12, and which is supported on, or carried by, that frame in any appropriate manner, such as upon beam structure in the main frame which is not illustrated herein, are poured-in-place concrete floor structures, such as the floor structure shown generally at 24 (in two fragments) in FIG. 1. Essentially, for each story in building 10, a floor structure, like floor structure 24, is put into place, and as can be seen in FIG. 1 for floor structure 24, these floor structures lie substantially in vertically spaced horizontal planes which lie at substantially the same elevations where the sub-frame overhead beam components are also located. This is clearly pictured for floor structure 24 in relation to overhead beam component 18*a* in FIG. 1. Each floor structure has lateral edges, such as lateral edge 24*a* in floor structure 24, which lie inwardly of, and closely adjacent, the inner side of main frame structure 12, as such is defined by columns like the two columns shown at 14 in FIG. 1.

Still continuing with the description of what is shown in FIG. 1, extending laterally and horizontally inwardly from each of the overhead beam components in the sub-frames are plural, laterally spaced, elongate rebar rods, or rebar-like elements, also referred to herein as load-transfer elements and as lateral extension elements, such as the elements shown generally and fragmentarily at 25 in FIG. 1. As will be more fully explained very shortly, the outer ends of these rebar-like elements (referred to hereinafter simply as rebar elements) are appropriately anchored to a sub-frame's overhead beam component, with inner ends of the rebar elements extending into and being embedded by and within the various poured-in-place floor structures. These rebar elements thus effectively extend through the plane occupied by the outer columns in frame 12, between the outer-skin sub-frames and the inner-floor-structure infrastructure in building 10.

Figure 3:
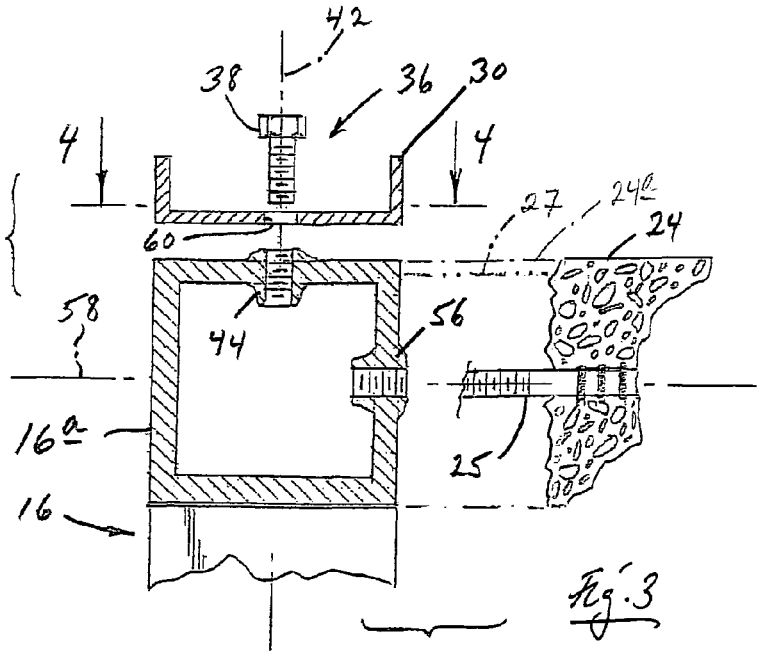
FIG. 3 is a further enlarged, detailed, fragmentary view, partly in cross-section, taken generally along the line 3-3 in FIG. 2.

With a brief digression here made to FIG. 3, a dash-double-dot line 27 in this figure shows another form for a lateral extension element which is suitably joined to overhead beam component 16*a* as a cantilevered element. FIG. 3 also illustrates, by dash-dot lines 24*a*, the fact that floor structures 24 may receive edge form definition from overhead beam components, such as is illustrated with respect to beam component 16*a* in this figure.

Not specifically shown in FIG. 1, but now to be described in conjunction with the remaining drawing figures, plural bolt structures extend between the regions of interfacial vertical adjacency between next-adjacent sub-frames to anchor the base of each sub-frame to the top of the immediately below sub-frame. This arrangement, along with other details associated with the present invention, will now be described as FIGS. 2, 3 and 4 are viewed and read in conjunction with FIG. 1.

Figure 4:
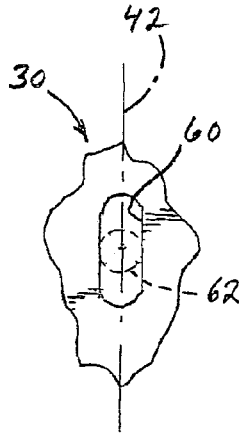
FIG. 4 is a fragmentary view, generally on the same scale as that which is employed in FIG. 3, taken generally along the line 4-4 in FIG. 3.
Figure 2:
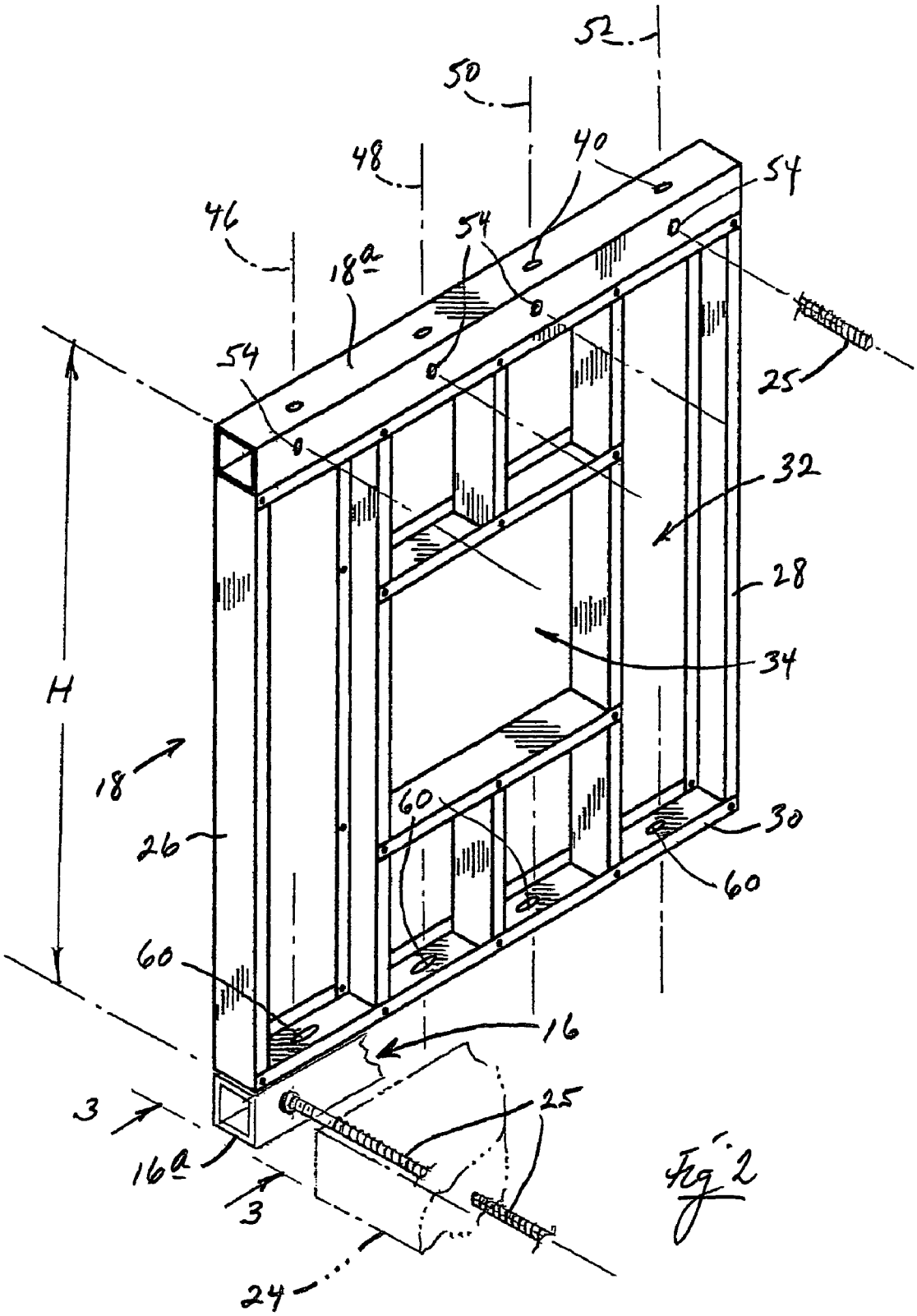
FIG. 2 presents a more detailed, enlarged, isolated, isometric view of a single one of sub-frames like those which are shown (three are shown) schematically in FIG. 1.

The particular sub-frame (of those three which are pictured in FIG. 1) which is specifically shown in FIG. 2-4, inclusive, is sub-frame 18. This sub-frame is seen to include, of course, overhead beam component 18*a* which forms the upper perimetral edge in sub-frame 18. The remainder of the perimetral edge structure in sub-frame 18 includes a pair of laterally spaced upright channels 26, 28, the lower ends of which are joined by a horizontal, upwardly facing base channel 30. Appropriately mounted and disposed inside the perimeter components of sub-frame 18 are other sub-frame components, shown generally at 32, which do not form any part of the present invention. These other components essentially give definition to the ultimate use to which a sub-frame, such as sub-frame 18, may be put. For example, with respect to sub-frame 18, these other sub-frame components define a window opening which is shown generally at 34 in FIG. 2.

Shown fragmentarily at 16*a* in FIG. 2 is the previously mentioned overhead beam component which defines the upper edge in sub-frame 16. As can be seen, component 16*a* immediately underlies base channel 30 in sub-frame 18, and is connected to sub-frame 18 through channel 30 in a manner now to be described.

In FIG. 2, the hardware which is employed, in accordance with the invention, to establish a vertical next-adjacency interconnection between sub-frames 16, 18 is omitted, but is shown generally at 36 in FIG. 3. As will be explained more fully shortly, this interconnection hardware preferably includes threaded bolts, such as the bolt shown at 38 in FIG. 3, which bolts are also referred to herein as anchoring connectors. As was mentioned earlier herein, instead of using threaded bolts, elongate, in-plane, tongue-and-groove structures could be used if desired.

In the embodiment of the invention now being described, each overhead beam component in a sub-frame is formed as an elongate, generally square-cross-section, tubular element whose upwardly facing portion is provided with a plurality of laterally distributed apertures, referred to herein as interconnect-accommodating site structures, such as those shown at 40 in FIG. 2. These upwardly facing apertures in an overhead beam in a sub-frame are collectively referred to as a first site-structure set wherein the apertures define an upright interconnect plane, such as that shown by dash-dot lines 42 in FIGS. 3 and 4.

Focusing attention again for a moment particularly on FIG. 3, and recognizing that this figure provides a cross-sectional illustration of the region of interconnection between channel 30 in sub-frame 18 and overhead beam component 16*a* in sub-frame 16, included in the upwardly facing portion of beam component 16*a* are plural apertures, such as aperture 44, which are generally the same in construction and distribution as are apertures 40 in beam component 18*a*. This region of interconnection in FIG. 3 is shown there in a somewhat exploded condition.

Preferably, the apertures which have been mentioned so far herein are formed in a special, through conventional, manner to create, with respect to an overhead beam component, a specially shaped, homogeneous aperture structure, such as is illustrated especially well in FIG. 3, utilizing the so-called FORMDRILL® thermo-drilling system which is described in literature of, and made available by, a company in Libertyville, Ill. know as Danly Tool and Equipment Inc. While such a technology is employed preferably to form the apertures discussed in the disclosure of this invention, it should be understood that other kinds of aperture formation, such weld attachment of appropriate bushings, may be used if desired. As can be seen in FIG. 3, aperture 44 is internally threaded to receive a bolt, such as previously mentioned bolt 38, and this condition for aperture 44 is the same in all of the other apertures employed herein in the embodiment of the invention which is now being described.

These apertures which are formed in the upwardly facing portions of overhead beam components in the sub-frames of the invention define elongate connection axes which lie in previously mentioned plane 42, with four of these axes being illustrated at 46, 48, 50, 52 in FIGS. 1 and 2.

Similarly formed in the laterally inwardly facing sides of the sub-frames' overhead beam components are other linearly distributed interconnect-accommodating site structures in the form of apertures, such a apertures 54 shown in FIG. 2 in overhead beam component 18*a*, and aperture 56 shown in FIG. 3 in overhead beam component 16*a*. These laterally facing apertures, with respect to each overhead beam component, are referred to collectively as another site-structure set, with these apertures defining generally horizontally disposed interconnect planes, such as the plane shown at 58 in FIG. 3. Planes 42, 58, as can be seen clearly in FIG. 3, lie in an orthogonal relationship with respect to one another.

Retuning focus for a moment to base channel 30 in sub-frame 18, which base channel is representative of all base channels in all of the sub-frames being discussed herein, distributed laterally and spatially in the central web in these base channels is a set of apertures, such as those shown at 60 in FIGS. 2-4, inclusive, which preferably are somewhat ovate in shape as illustrated especially well in FIGS. 2 and 4.

In an alternative form of the invention, ovate apertures 60 may be made as circular apertures, such as the single circular aperture shown in dashed lines at 62 in FIG. 4. These apertures provide slight amounts of lateral clearance for the threaded shanks in bolts, such as bolt 38, and the reason for this is to permit a modest amount of in-plane lateral relative motion between a pair of next-adjacent interconnected sub-frames. Specifically, such motion is permitted in a plane such as previously mentioned plane 42.

When sub-frames are appropriately mounted on the outside of a main building frame, bolts, such as bolt 38, are extended through the apertures provided in the base channels in these sub-frames, with these bolts then threaded into the related underlying aperture in an overhead beam component, such as into apertures 40, 44 discussed above. If desired, such a bolt interconnection may be made in a fashion which additionally permits a very slight amount of in-plane vertical relative motion between vertically next-adjacent sub-frames.

Elongate rebar elements, such as elements 25, possessing appropriately threaded ends are screwed into the laterally facing apertures in a sub-frame's overhead beam component, such as within aperture 58 in overhead beam component 16*a*, with these rebar elements then extending inwardly in the building structure to become embedded in subsequently poured-in-place concrete floor structure, such as previously mentioned floor structure 24. It will be apparent that putting into place bolts such as bolt 38, and rebar elements, such as elements 25, can all easily take place from the inside of the emerging building structure.

What results from the introduction of the mentioned bolts and rebar elements, and subsequent to pouring in place of the various floor structures, is a unique inter-sub-frame connection which allows certain limited amounts of in-plane relative motion, and as well, a significant load-transfer horizontal connection between the overhead beam component in each sub-frame and the poured-in-place floor infrastructure within the associated building structure. These rebar implemented lateral connections thus provide outstanding load-handling conditions with respect to lateral loads, such as wind loads exerted on the outside surface of a finished building. In the described preferred embodiment of the invention, the rebar elements cross, in a normal angular sense, the plane of the outside of a building frame. In an alternative embodiment (not specifically shown in the drawings, but rather expressed in words), rebar-like elements may extend from panels that are disposed inwardly of a building frame also in a disposition which is generally normal to the outside upright plane of a building frame, but not necessarily across that plane.

Accordingly, while a preferred embodiment of the invention has been illustrated and described herein, and certain modification suggested, it is appreciated that other variations and modifications may be made without departing from the spirit of the invention.

I claim:

1. A generally planar, rectilinear, skin-panel sub-frame having spaced, upper, lower and lateral edges, and designed to occupy, along with other like sub-frames, an upright plane adjacent the outside of a plural-story building frame, and to possess a vertical dimension which is substantially the same as inter-floor story-height in the frame, and where the frame supports building infrastructure in the form of plural, poured-in-place concrete, vertically spaced floor structures, said sub-frame comprising an elongate beam component defining the sub-frame's upper edge, and plural interconnect-accommodating site structures formed in and distributed along the length of said elongate beam component, including a first, upwardly facing site-structure set, and a second, laterally inwardly facing site-structure set, said first and second site-structure sets defining orthogonally intersecting interconnect planes, said first site-structure set accommodating a first position-stabilizing and load-transferring inter-sub-frame interconnection between a pair of vertically next-adjacent sub-frames, and said second site-structure set including plural bores formed in said elongate beam accommodating a second position-stabilizing and load-transferring interconnection between a sub-frame and a floor structure in the mentioned building infrastructure, and said second position-stabilizing and load-transferring interconnection, for each of said bores, taking the form of an elongate, unitary, generally horizontal load-transfer element in the configuration of a rod having one end affixed to said sub-frame's elongate beam component within a bore therein, and having its opposite end embedded within a floor structure.

2. The sub-frame of claim 1, wherein inter-sub-frame interconnection is established through structure which permits a limited amount of in-plane vertical and horizontal relative movement between vertically next-adjacent sub-frames.

3. The sub-frame of claim 1, wherein each elongate rod is formed of rebar, having one end thereof threaded for threaded fixing within a bore.

4. A plural-story building structure comprising a main frame including laterally spaced, upright columns defining, nominally, an outside, upright, generally planar main frame expanse, plural, poured-in-place concrete, generally evenly vertically spaced, substantially horizontal and planar floor structures operatively supported by said columns and including lateral edges disposed inwardly adjacent said columns, plural, modular, generally planar, skin-panel sub-frames having perimeter edges, and arranged in row-and-column, edge-by-edge, vertical and lateral next-adjacency, each sub-frame possessing a vertical dimension which is substantially the same as an integer multiple of the vertical spacings existing between said floor structures, and including an elongate, overhead, substantially horizontal beam component, said beam component including plural laterally facing bores formed on an interior, relative to said building structure, side thereof, and generally horizontal load-transfer structure including elongate, generally horizontal load-transfer elements anchorably linking, at said bores, said sub-frames and said floor structures generally in the planes of said floor structures, and substantially normal to the planes of said sub-frames, and extending generally normal to the nominal plane of said outside, main-frame expanse, said load-transfer elements each having one end anchored to a sub-frame's said overhead beam component, and its opposite end extending through an edge of, and embedded within, a floor structure.

5. The structure of claim 4, wherein, relative to the interface which exists between vertically next-adjacent sub-frames, there are provided plural, anchoring, connector structures extending vertically between and interconnecting these sub-frames.

6. The structure of claim 5, wherein said anchoring, connector structures engage vertically next-adjacent sub-frames in a manner permitting a limited amount of vertical and horizontal, in-plane relative motion therebetween.

7. The structure of claim 4, wherein said horizontal load-transferring elements includes, for each bore, an elongate rod fixed within said bore and extending into and embedded in said floor structure.

8. The subframe of claim 7, wherein said elongate rod is formed of rebar, having one end thereof threaded for threaded affixing within a bore.

* * * * *